United States Patent [19]

Nakashima et al.

[11] Patent Number: 4,724,424

[45] Date of Patent: Feb. 9, 1988

[54] WARNING CHORD SOUND PRODUCING APPARATUS INCLUDING AN INTEGRATED CIRCUIT

[75] Inventors: Toru Nakashima, Kariya; Haruhiko Inoue, Nagoya; Hirofumi Iwata, Hashima, all of Japan

[73] Assignee: Nippondenso Co., Ltd., Kariya, Japan

[21] Appl. No.: 815,825

[22] Filed: Jan. 2, 1986

[30] Foreign Application Priority Data

Jan. 7, 1985 [JP] Japan ..... 60-1158
Apr. 15, 1985 [JP] Japan ..... 60-79722

[51] Int. Cl.[4] ..... G10K 9/12

[52] U.S. Cl. ..... 340/384 E; 340/384 R; 340/388

[58] Field of Search ..... 340/384 R, 384 E, 388, 340/402, 404; 116/137 R, 140, 142 R; 179/115 R, 115.5 ES, 115.5 H; 181/152, 157, 159, 156, 192, 150; 310/324; 84/1.01

[56] References Cited

U.S. PATENT DOCUMENTS

| | | | |
|---|---|---|---|
| 3,254,336 | 5/1966 | Campbell | 340/384 E |
| 3,504,364 | 3/1970 | Abel | 340/384 E |
| 3,578,912 | 5/1971 | Beavers, Jr. | 340/384 E |
| 3,747,092 | 7/1973 | Smith | 340/384 E |
| 4,159,472 | 6/1979 | Murakami et al. | 340/384 R |
| 4,180,809 | 12/1979 | Feldstein | 340/384 E |
| 4,189,718 | 2/1980 | Carson et al. | 340/384 E |
| 4,195,284 | 3/1980 | Hampshire et al. | 340/384 E |
| 4,326,276 | 4/1982 | Scott, Jr. | 340/384 E |
| 4,347,403 | 8/1982 | Schwager et al. | 340/384 E |
| 4,486,742 | 12/1984 | Kudo et al. | 340/384 E |
| 4,626,799 | 12/1986 | Matievic | 340/384 E |
| 4,631,517 | 12/1986 | Ajland | 340/384 E |
| 4,641,054 | 2/1987 | Takahata et al. | 340/384 E |
| 4,668,937 | 5/1987 | Shota | 340/384 R |

FOREIGN PATENT DOCUMENTS

| | | |
|---|---|---|
| 57-210395 | 12/1982 | Japan . |
| 58-111988 | 7/1983 | Japan . |

OTHER PUBLICATIONS

U.S. Ser. No. 682,755, filed 12-17-84, by Nakashima et al.

*Primary Examiner*—James L. Rowland
*Assistant Examiner*—Brent A. Swarthout
*Attorney, Agent, or Firm*—Cushman, Darby & Cushman

[57] ABSTRACT

A 1-bit microcomputer driven by a clock signal has first and second output ports. The signals from these output ports control first and second transistors whose output signals are supplied to step-up transformers. The output signals from these transformers drive the sounding devices constructed of piezoelectric elements to produce a chord sound. The memory of the microcomputer stores a program by which first and second square-wave pulse-train signals formed of a combination of a plurality of square wave pulses and in which each unit pulse train has a mutually different basic frequency are output from the first and second output ports.

16 Claims, 37 Drawing Figures

FIG. 2

| ADDRESS | COMMAND |
|---|---|
| 0 | INITIALIZE |
| 1 | |
| 2 | |
| 3 | |
| 4 | NO COMMAND |
| 5 | |
| 6 | |
| 7 | |
| 8 | 2nd PORT; HIGH |
| 9 | 1st PORT; HIGH |
| 10 | NO COMMAND |
| 11 | |
| 12 | |
| 13 | |
| 14 | |
| 15 | |
| 16 | 2nd PORT; LOW |
| 17 | NO COMMAND |
| 18 | |
| 19 | 1st PORT; LOW |
| ⋮ | |
| 239 | RETURN TO ADDRESS "0" |

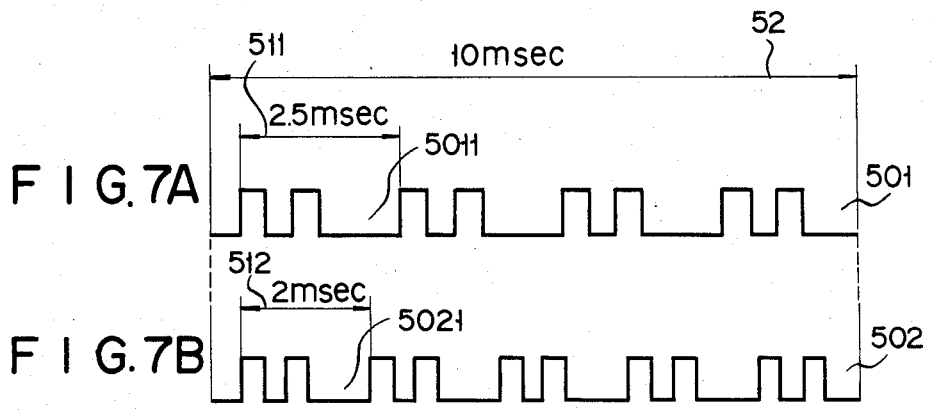
FIG. 7A
FIG. 7B
FIG. 8
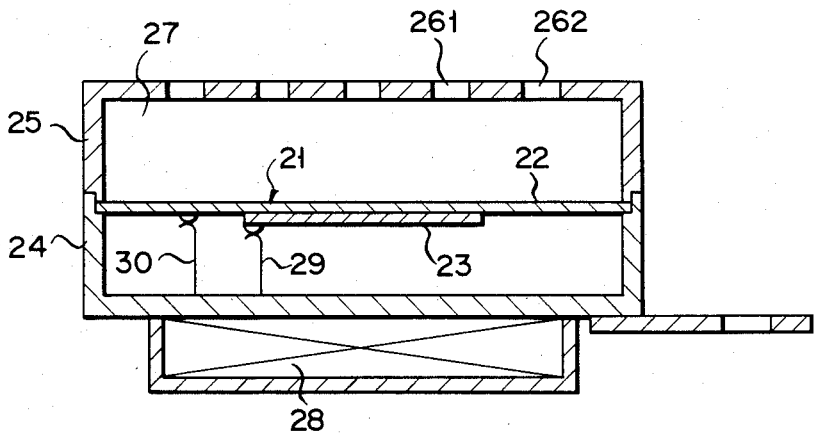

FIG. 11A
FIG. 11B
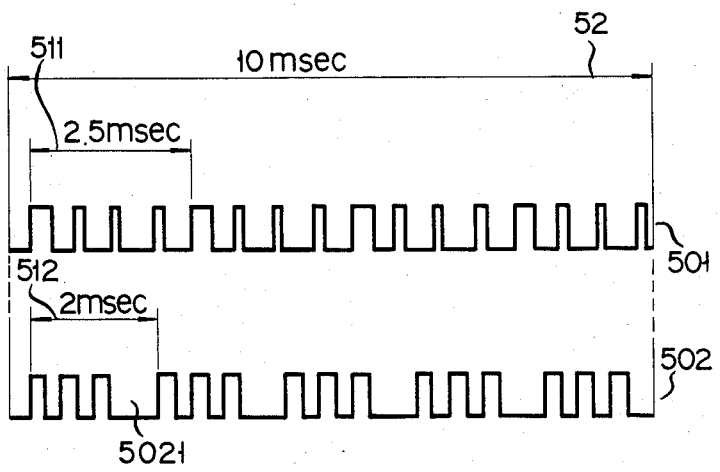
FIG. 12A
FIG. 12B
FIG. 12C
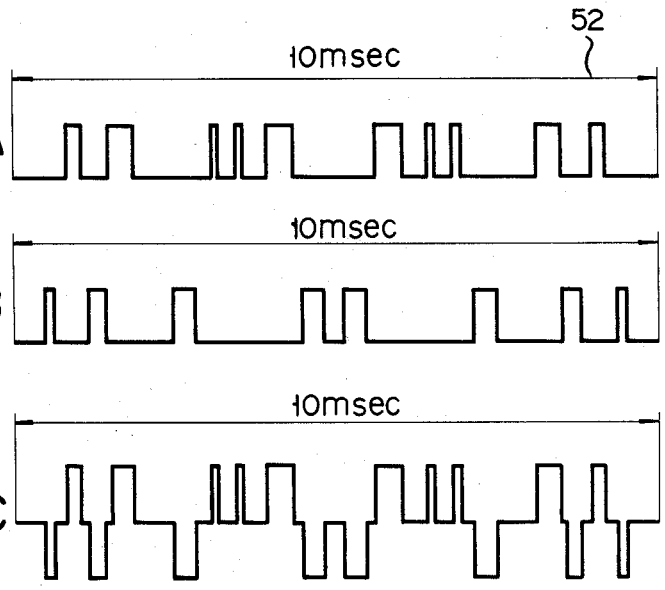

WARNING CHORD SOUND PRODUCING APPARATUS INCLUDING AN INTEGRATED CIRCUIT

BACKGROUND OF THE INVENTION

This invention relates generally to a warning sound generator such as the horn of an automobile, and particularly to a generator that uses an IC to produce a euphonious sound.

With automobile horns it is particularly desirable that the sound include two tones of different basic frequency components rather than be a sound of one clear tone. The two tones in this case have basic frequency components in the 200–700 Hz range. The sound pressure component of the sound that is produced should comprise a higher order harmonic tone within the frequency range of 1–3 KHz, which is most suitable for producing a pleasant sound.

In automobile horns a piezoelectric element is used to drive a diaphragm to produce the sound. An example of this kind of sound generator is shown in Japanese Patent Disclosure (KOKAI) No. 57-210395. Two oscillator circuits are provided for producing two pulse signals having different basic frequency components for producing a chord. These two pulse signals are modulated under different conditions so that they each include the above basic frequency components as well as many special higher order harmonics. These pulse-train signals drive the piezoelectric element to produce a warning sound comprising a chord.

However with a device constructed as described above, two separate oscillator circuits and two modulator circuits must be used, resulting in a complicated device. It is also not possible to freely set the higher harmonic components, which is a major requirement in determining the timbre of the sound that is produced, so that it is difficult to produce a horn that has a pleasant sound.

In order to solve this problem, a microcomputer may be used to form a signal having a waveform synthesized from two different basic frequency components for driving the horn, which is a technology that is known from electronic musical instruments and synthesizers, for example. However, using a microcomputer for the horn of an automobile is silly, and prohibitively expensive.

This problem has been solved through the use of a melody generation IC which has a memory function for storing waveform data or a very low-power, low-cost microcomputer such as a 1-bit microprocessor, thereby eliminating the need for a microcomputer that can perform such complicated calculations. By using a piezoelectric element in the horn it is possible to produce a sound of any particular timbre by continuously outputting a square wave pulse. Accordingly, two types of square wave pulses for generating a predetermined sound are stored in two separate memories and the sound is generated based on the waveform signal read out from these memories.

This kind of structure, however, has the drawback that at least two memories, two integrated circuits or a microcomputer are required, which makes it difficult to simplify the structure.

SUMMARY OF THE INVENTION

The object of the invention is to provide a horn which uses one simple integrated circuit or a microcomputer that uses very few bits to produce a sound that is pleasant to hear.

Another object of the invention is to provide a horn which can produce a pleasant sound using a simple integrated circuit or a 1-bit microcomputer and which is compact and low cost.

The horn of this invention uses a multi-port microcomputer that uses very few bits of data, e.g., one bit, or a melody signal generating integrated circuit also having a plurality of output ports. A plurality of semiconductor switching elements are switched by signals supplied from these IC output ports. A sound signal, which substantially includes chord components, is produced based on the output signals obtained corresponding to the switch elements being turned on and off, and the sound generator is driven by this sound signal.

The integrated circuit has memories from which square-wave pulse-train signals formed of successive high and low level signals are output based on a determined program via a plurality of output ports. This square-wave pulse-train signal includes a plurality of basic frequency components required to substantially constitute a chord and harmonics of these basic frequency components that are several times higher than the basic frequency components. The integrated circuit repeatedly outputs the data read out from the memory by way of the output ports in a chord period. A plurality of unit periods, each one of which is constituted by a plurality of basic frequency components, is programmed to be included in this chord cycle. The plurality of semiconductor switching elements are controlled such that they are not on or off simultaneously.

These semiconductor switching elements amplify the output signals from the integrated circuit and increase the pressure of the sound produced by the horn. The square-wave pulse-train signals of the integrated circuit are determined in consideration of the timing of the low-high level switching and, by varying the pulse period and, further, by varying the duty (by varying the pulse waveform), it is possible to freely determine the timbre of the sound to produce a chord with a sound signal having two different timbres.

It is known to produce a sound using a pulse-train signal in which each unit of the signal is formed of a combination of square-wave pulses. However, in this invention a plurality of unit pulse-train signals are synthesized to substantially establish a chord relationship.

Each of these unit pulse trains is formed of a pulse train that constitutes one basic frequency component and a pulse train that constitutes a harmonic component that is three to four times higher than this basic frequency component. Although a plurality of such unit pulse-trains are used one continuous square-wave pulse-train signal is formed. To be more precise, a unit pulse train signal is not a combination of square wave pulse signals having the same waveform. A pulse train signal is formed by combining a plurality of pulse signals which have been modulated to have for example low and high level portions whose duty cycles have a time interval relationship of 2:1 or 3:1. These pulse trains also contain pulse loss portions. The result is a sound which has a pleasant timbre and which has an improved warning effect.

In consideration of the functional restrictions of an integrated circuit such as a 1-bit microcomputer, the output signals from the first and the second output ports are controlled such that the semiconductor switching elements are turned on and off alternately and the inversion timing is not simultaneous. For example, one of two output ports will be instructed to vary its output level from high to low or low to high at an odd address and the other output port will be instructed to vary its output level at an even address so that the two semiconductor switching elements will not be simultaneously inverted.

The memory provided for such an integrated circuit has restricted capacity and, accordingly, in order to consecutively produce a chord sound, the inventor paid particular attention to the chord period. The basic unit period of a unit pulse train signal which includes basic frequency components of 400 Hz, for example, is $1/400=0.0025=2.5$ ms. The basic frequency of a tone that has a chordal relationship to a 400 Hz tone is 500 Hz and the unit frequency is $1/500=0.002=2$ ms. Accordingly, the lowest common period that includes an integral number of 2.5 ms and 2 ms periods forms one chord period. So, if the output ports of the integrated circuit are repeatedly accessed, a continuous warning sound can be produced. If the chord period is 10 ms, four pulse train signals having a unit period of 2.5 ms and five pulse train signals having a unit period of 2 ms are output. This chord period may of course be 20 ms. If the pulse trains of the two different unit periods in this chord period do not contain integral components, the sound that is generated will have an inferior quality.

With a horn that is constructed as described above it is possible to generate a sound that is substantially a chord and that sounds pleasant. The integrated circuit used in such a device requires only a simple structure such as that of a 1-bit microcomputer, which is very cheap, compact and of reliable quality. This device also has the superlative feature that the specifications can be changed to produce different timbred sounds. Also, while the sound is being produced, the harmonics, which have a great influence on the sound pressure, are made to include frequency components that produce a chord. It is therefore easy to increase the force of the warning sound. This kind of apparatus can be simply located in the horn housing for easy attachment to an automobile.

BRIEF DESCRIPTION OF THE DRAWINGS

This invention may be better understood with reference to the drawings in which:

FIG. 2 shows the microcomputer program of the above apparatus;

FIGS. 7A and 7B are examples of square-wave pulse-train signals output from the output ports of the microcomputer;

FIG. 8 is a cross section of an example of a horn that is driven based on the above signals;

FIGS. 11A AND 11B show other examples of square-wave pulse-train signals;

FIGS. 12A and 12B show another example of square-wave pulse-train signals and FIG. 12C shows the waveform of the two signals when subtracted;

DETAILED DESCRIPTION OF THE PREFERRED EMBODIMENTS

Figure 1:
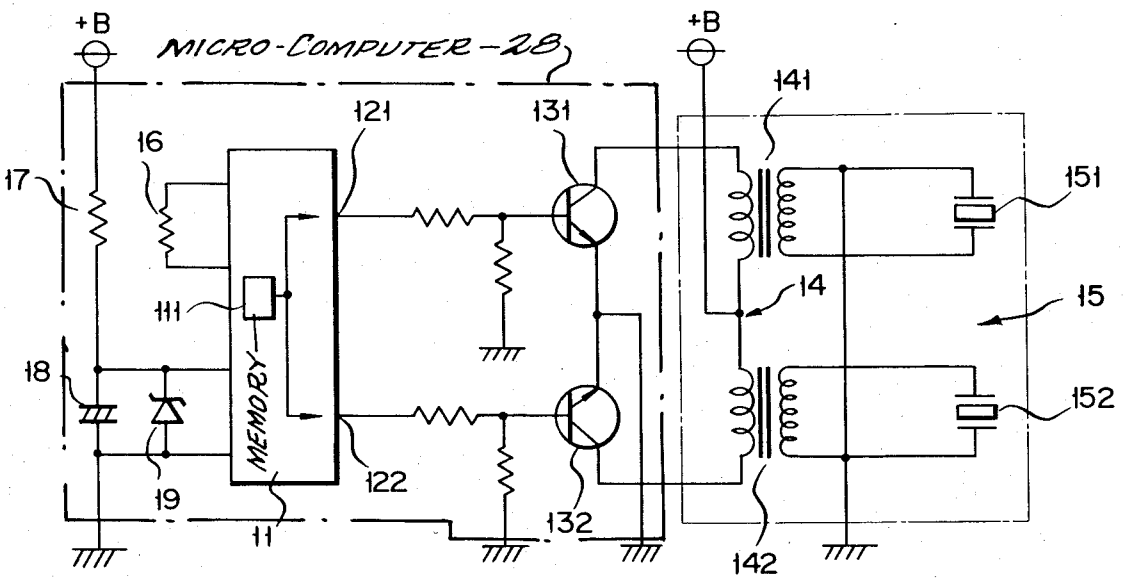
FIG. 1 is a circuit diagram of the horn according to the first embodiment of this invention.

FIG. 1 a circuit diagram of a horn according to the first embodiment of the invention, includes 1-bit microcomputer 11, which has first and second output ports 121 and 122 the signals from which are supplied respectively to the bases of first and second transistors 131 and 132, which constitute switching elements. Microcomputer 11 contains memory 111 and the 1-bit data read from this memory is output from output ports 121 and 122.

The collector electrodes of first and second transistors 131 and 132 are connected to voltage source +B via the primary coils of first and second step-up transformers 141 and 142, respectively. Voltage source +B is set at 13 V and the step-up ratio between the primary and secondary side of the transformers is 1:10. The secondary windings are connected to first and second sounding devices 151 and 152 which constitute sounding apparatus 15. Sounding devices 151 and 152, which are well known technology, are constructed of thin-plate piezoelectric elements which vibrate mechanically in response to signals supplied from a transformer. This vibration causes the diaphragm to produce a sound.

A 1MΩ resistor 16 for setting the oscillation frequency is connected to microcomputer 11 and a clock signal of fc=24 KHz is produced. Resistor 17, capacitor 18 and Zener diode 19 form a constant-voltage power supply circuit for microcomputer 11.

FIG. 2 shows the program used by this 1-bit microcomputer. This program comprises commands for specifying whether the signals output from ports 121 and 122 are low (LOW) or high (HIGH) level. One cycle contains 240 commands which are repeated. As this microcomputer cannot process more than one bit at a time, odd addresses are specified for one output port 121 and even addresses are specified for the other output port 122. These output ports are accessed at high or low levels and for odd and even addresses. One command corresponding to an address is executed by one clock signal at an execution time of $1/fc=41.7\mu s$ in one cycle of $240\times 1/fc=10$ ms.

Figures 3A, 3B:
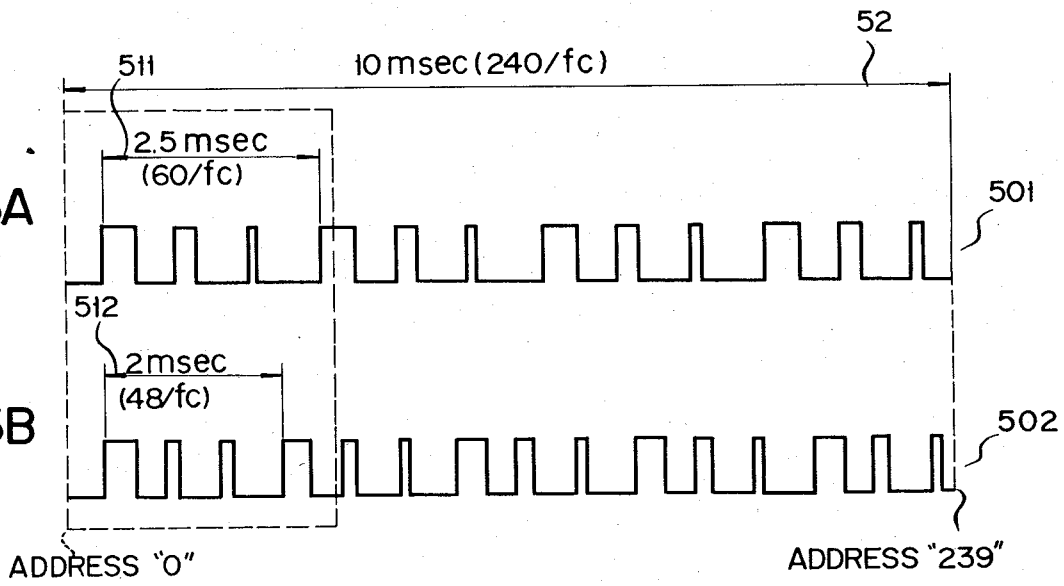
FIGS. 3A and 3B show the waveforms of the square-wave pulse-train signals obtained from the port of the microcomputer.

FIGS. 3A and 3B show the output signals of first and second output ports 121 and 122, which are formed of square-wave pulse train signals. The output signal of the first output port 121 is formed of a pattern 501 of the unit pulse train in which unit period 511 is 2.5 ms and is repeated four times in one cycle of the program. Unit period 511 has three high level periods, or, three square wave pulses, of different pulse widths that are pulse-modulated in each unit period 511.

As shown in FIG. 3B, the output signal of the second output port 122 is formed of a pattern 502 of the unit pulse train in which unit period 512 is 2 ms and is repeated five times in one cycle of the program. Unit period 512 has three high level periods, or, three square wave pulses, of different pulse widths that are pulse-modulated in each unit period 512.

Figures 4A, 4B:
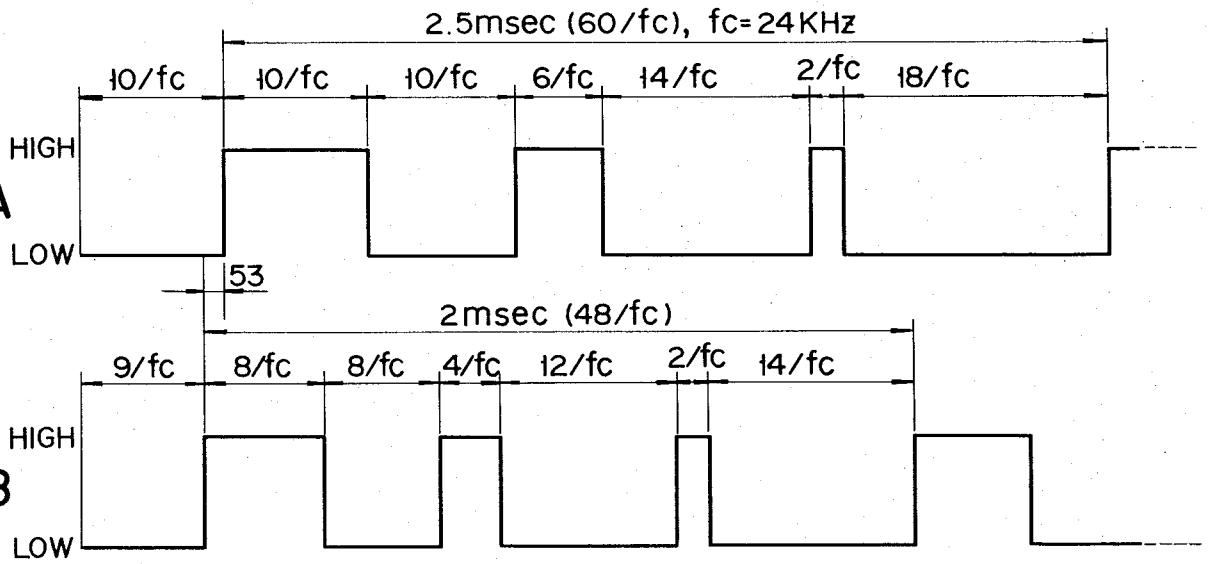
FIGS. 4A and 4B are enlarged views of the unit period portion of the waveforms shown in FIGS. 3A and 3B.

FIGS. 4A and 4B show an enlargement of the area enclosed by the broken line in FIG. 3. The timing for inverting the output signals from output ports 121 and 122 is generated such that the inversion is not simultaneous. This can be understood from the program shown in FIG. 2 in which the inversion timing difference portion of the first and second output signals from output ports 121 and 122 constitutes one clock timing.

It is known that the ratio of the basic frequencies of the two sound signals that constitute the warning sound should be 4:5 or 5:6 in order to constitute a chord. The composition of a sound other than a warning has a basic frequency ratio of simple natural numbers such as "1", "2", "3". . . The basic frequency ratio of the sounds constituting a chord on the musical scale such as "C, E, G", "F, A, C" or "G, B, D", etc. is 4:5:6.

The inventors gave careful consideration to the apparent frequency characteristics corresponding to the lowest common harmonic of the unit period corresponding to an inverse number of the basic frequencies of the two signals that constitute the chord. When a chord is comprised of a first signal having a unit period of 2.5 ms (400 Hz) and a second signal having a unit period of 2 ms (500 Hz), the first signal is repeated four times and the second signal is repeated five times in each period (10 ms). The reference numeral 52 in FIG. 3 denotes a chord period.

The mutual relationship of the signals output from ports 121 and 122 of microcomputer 11 may be any relationship providing the signals are repeated in a chord period as described above. Accordingly, even a low power circuit apparatus such as a 1-bit microcomputer 11, which is not capable of complicated timing computations, is capable of continuously generating a signal which forms a chord by storing a program of the high and low levels of only one chord period such as that shown in FIG. 2 in memory 111, and repeatedly reading out and outputting these memory contents in accordance with a clock signal.

With the horn apparatus shown in FIG. 1, a square-wave pulse-train signal having high and low levels is repeatedly output from the first and second output ports 121 and 122 of microcomputer 11 in accordance with the program of FIG. 2, which is stored in memory 111 of microcomputer 11. The pulse train signals that are output comprise the basic frequency components for substantially forming a chord and square-wave pulse signals which include harmonic components that are multiples of the basic frequencies. These pulse train signals are pulse modulated for every unit pulse train.

One-bit microcomputer 11 is programmed such that the timing of the inversing operation of transistors 131 and 132 is not simultaneous and that the data read out of memory 111 is distributed between the first and second output ports 121 and 122 and is output repeatedly. In this case, one repetition period is programmed to include a plurality of unit periods 511 and 512 of the basic frequencies in one chord period.

If the period corresponding to the lowest common harmonic of the first and second square-wave pulse train signal output from the first and second ports 121 and 122 is programmed to match chord period 52, it is possible to limit the memory capacity required to the minimum possible.

Microcomputer 11 is programmed such that first and second ports 121 and 122 are accessed at odd and even numbered addresses. Accordingly, first and second transistors 131 and 132 are not inverted at the same timing so even with a 1-bit microcomputer where only one input/output port can be accessed by one command, it is possible to output a first and second pulse train signal such as that shown in FIGS. 3A and 3B.

The pulse train signal, which is produced from the second output port 122 based on the program shown in FIG. 2, has the waveform shown in FIG. 3B and one unit period of this signal is shown in FIG. 4B. The relationship between the pulse widths of the three pulse signals that constitute one unit period is 8:4:2, as is shown in FIG. 5A.

Figures 5A, 5B, 5C:
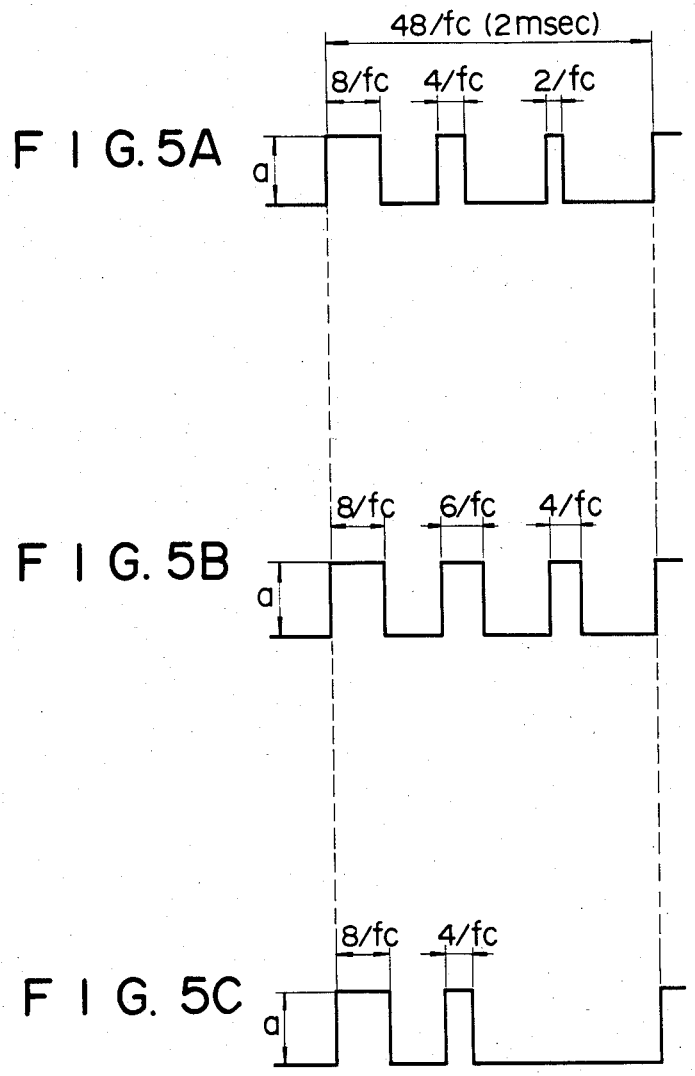
FIGS. 5A to 5C are examples of the different unit pulse trains.
Figure 6A:
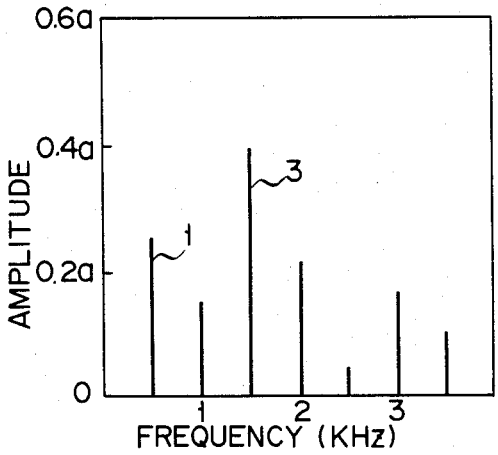
FIGS. 6A to 6C show the frequency characteristics of the waveforms shown in FIGS. 5A to 5C.
Figure 6B:
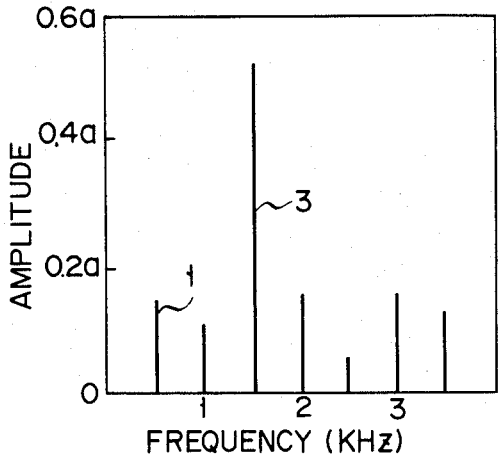
Figure 6C:
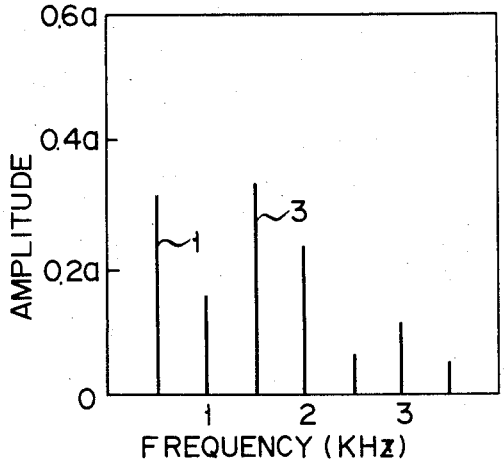

FIG. 6A shows the frequency characteristics of the sound produced by this kind of pulse train signal (FIG. 5A). The third harmonic component 3 of basic frequency component 1 is at the high level and the level of the pulse train signal at a is taken as the reference. The pulse train signals shown in FIGS. 5B and 5C have the frequency characteristics shown in FIGS. 6B and 6C.

In FIG. 5B the pulse widths of the three pulse signals have an 8:6:4 relationship. In this case the third harmonic component has a particularly large amplitude resulting in a sound in which the harmonic component has high pressure. In FIG. 5C the unit pulse period comprises two pulses having a width relationship of 8:4. In this case, basic frequency component 1 is large and the sound has a soft character.

FIGS. 7A and 7B show other examples of square-wave pulse-train signals that are output from first and second output ports 121 and 122. In this example pulse signals with uniform pulse widths are used. Unit periods 511 and 512 of each square-wave pulse train have an arbitrary number of pulses and are especially set to include pulse loss portions 5011 and 5021. When this kind of a signal is used, many third harmonic components as well as the basic frequency component are included.

Transistors 131 and 132 are controlled by this kind of square-wave pulse-train signal and sounding apparatus 15 is driven by sounding devices 151 and 152. FIG. 8 shows the specific structure of one of the sounding devices. Sounding member 21, which is driven by the output signal from transistor 131 or 132, comprises thin-plate piezoelectric elements 23 which are attached to diaphragm 22. Sounding member 21 is attached near the opening of the first housing 24 so as to cover the opening and a second housing 25 is attached near the opening of first housing 24 to act as a lid. Sounding member 21 is held between the first and second housings 24 and 25.

A number of holes 261, 262, . . . are formed in second housing 25 facing sounding member 21. These openings transmit the sound produced by sounding member 21 to the outside. Air layer 27 is formed in second housing 25 which is partitioned by sounding member 21.

The transistor and transformer, etc. of the drive circuit 28 shown in FIG. 1 is attached to the outside of first housing 24. Drive circuit 28 supplies sound drive signals to sounding member 21 via lead wires 29 and 30.

With this kind of horn apparatus, the shape of each part, the material and the size, etc. of all the parts corresponding to sounding device 151 are all designed such that the primary resonance frequency will be 400 Hz and 1.2 KHz. The resonance frequency of the parts corresponding to sounding device 152 is set to be 500 Hz and 1.5 kHz.

Figure 9:
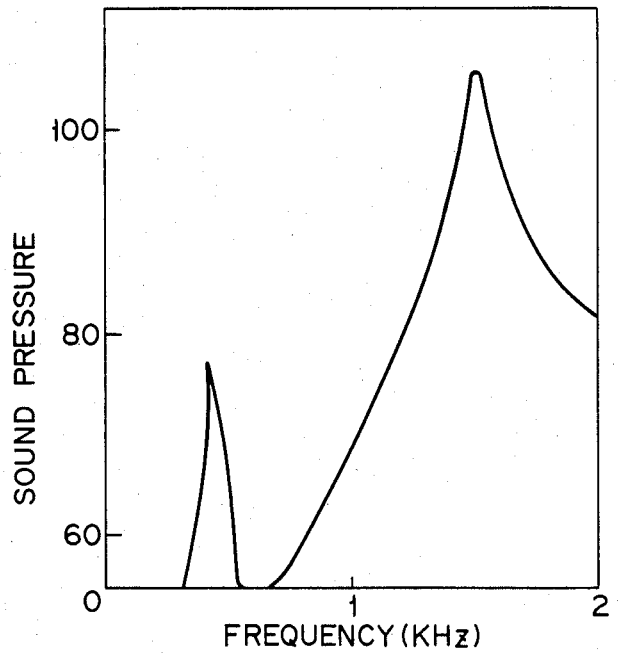
FIG. 9 shows the frequency characteristics of the above horn.

FIG. 9 shows the frequency characteristics for a horn which has a resonance frequency of 500 Hz and 1.5 kHZ.

Figure 10:
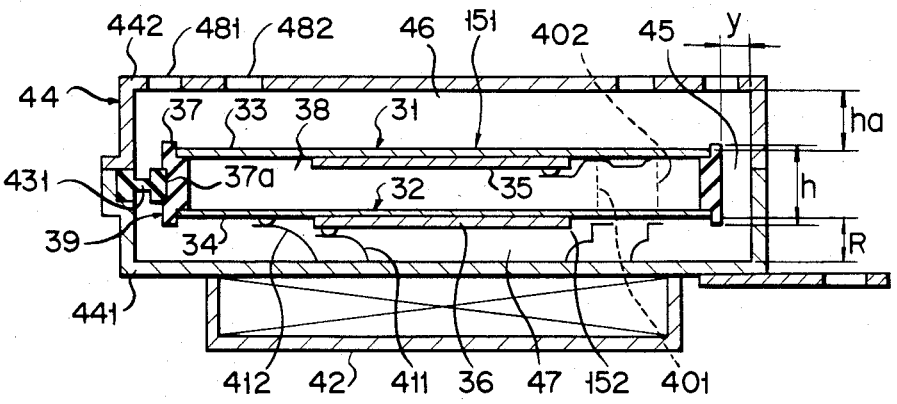
FIG. 10 is a cross section of another example of a sound generator.

When two square-wave pulse-train signals are used, in the example shown in FIG. 8, two sounding devices are required, but sounding devices 151 and 152 of FIG. 1 are formed as one unit as shown in FIG. 10.

The horn shown in FIG. 10 is equipped with first and second sounding members 31 and 32, which are formed of flat plates, and are arranged in parallel one above the other with a gap in between. These devices correspond to sounding devices 151 and 152 shown in FIG. 1. Sounding members 31 and 32 are constructed by laminating thin, disk-shaped piezoelectric elements 35 and 36 against circular, metal diaphragms 33 and 34. Piezoelectric element 35 has a diameter of 42 mm and a thickness of 0.3 mm, whereas piezoelectric element 36 has a diameter of 48 mm and a thickness of 0.3 mm. Diaphragm 33 is made of high nickel alloy such as KOBARU (manufactured by Nippon Kogyo KK), and diaphram 34 is made of brass. These diaphragms 33 and 34 both have a diameter of 90 mm and a thickness of 0.2 mm.

The outer periphery of first and second sounding members 31 and 32 are fastened to and supported by synthetic resin ring 37 thereby forming air chamber 38 in between. Sounding members 31 and 32 constitute sounding mechanism 39.

Sounding members 31 and 32 are connected to drive circuit 42 via lead wires 401, 402 and 411, 412. Lead wires 401 and 402 of first sounding member 31 are connected to drive circuit 42 via a groove (not shown) formed in ring 37. Four indentations 37*a* (three of which cannot be seen in the drawing) are formed in ring 37 and rubber support members 431 are inserted into indentations 37*a*. The other ends of support members 431 are attached to the inner wall of housing 44. Sounding mechanism 39 is elastically supported inside housing 44.

Housing 44 is constructed of body 441 and lid 442 which is fitted into the opening of body 441. Support member 431 is fitted into the indentation formed in the edge around the opening of body 441 by the pressure of lid 442.

By setting the external diameter of ring 37 at 93 mm and the inner diameter of housing 44 at 100 mm, a ring-shaped sound passage 45 with a length H and width y is formed around the periphery of ring 37. A front air layer 46 with a thickness ha of 11 mm is formed between first sounding member 31 and body 441 and a rear air layer 47 with a thickness R of 5 mm is formed between second sounding member 32 and body 441. Forty-eight openings 481, 482, . . . with 4.8 mm diameters for releasing the sound are formed distributed around the periphery of the portion of housing 44 that faces air layer 46.

This kind of apparatus is able to produce the same kind of chordal sound that is produced by driving two horns at the same time. When used on an automobile, for example, space can be saved and weight can be reduced.

In order to provide resonance characteristics in the low frequency range of an apparatus such as this, it is known to increase the diameter of the diaphragm portion or to make it thin and to immobilize the periphery. If the dimensions of the individual parts of the horn are set in this way, the primary resonance frequency of sounding members 31 and 32 becomes approximately 400 Hz and 500 Hz.

In the embodiment described above, the signal from first and second output ports 121 and 122 of microcomputer 11 is composed such that the sound contains more of the third harmonic components than any others. However, microcomputer 11 may be programmed such that other harmonic components corresponding to the frequency characteristics of sounding devices 151 and 152 predominate.

For example, if the square-wave pulse-train signals shown in FIGS. 11A and 11B are output from first and second ports 121 and 122, a sound will be generated having the fourth harmonic component at the maximum level.

In the above embodiment of FIG. 1 a chord was formed using two tones, but it is possible to use a 1-bit microcomputer that has three output ports which output three different square-wave pulse-train signals to generate three different tones. In such a case if pulse train signals having unit periods of 2.5 ms (400 Hz), 2 ms (500 Hz) and 1.67 ms (600 Hz), which would give them a frequency relationship of 4:5:6, are output from these ports, a three-tone chord will be generated. The chord period in this case is 10 ms.

The basic frequency components of the square-wave pulse-train signals output from ports 121 and 122 are different and the horn is driven by drive signals that are based on these signals.

The signals shown in FIGS. 12A and 12B may be added or subtracted in the microcomputer 11 and output from output ports 121 and 122. Microcomputer 11 of FIG. 13 subtracts the pulse train signals shown in FIGS. 12A and 12B to produce a signal having the waveform shown in FIG. 12C. This signal is output from first and second ports 121 and 122 with negative and positive sides, as shown in FIG. 12C, to control transistors 131 and 132.

In this case, the waveform shown in FIG. 12C, which is the result of subtracting the waveforms shown in FIG. 12A and 12B, is programmed into microcomputer memory. It is also possible to program the added result of these two waveforms.

First and second transistors 131 and 132, which are controlled by the output of microcomputer 11, are used as push-pull circuits whose output signal is supplied to step-up transformer 14, which has an intermediate tap terminal 143 connected to source +B.

The surge voltage generated when the transistors are inverted to off produces a 10 ms (100 Hz) harmonic distortion which is a chord period and deteriorates the quality of the sound. This surge voltage can be prevented by providing diodes 144 and 145.

Figure 13:
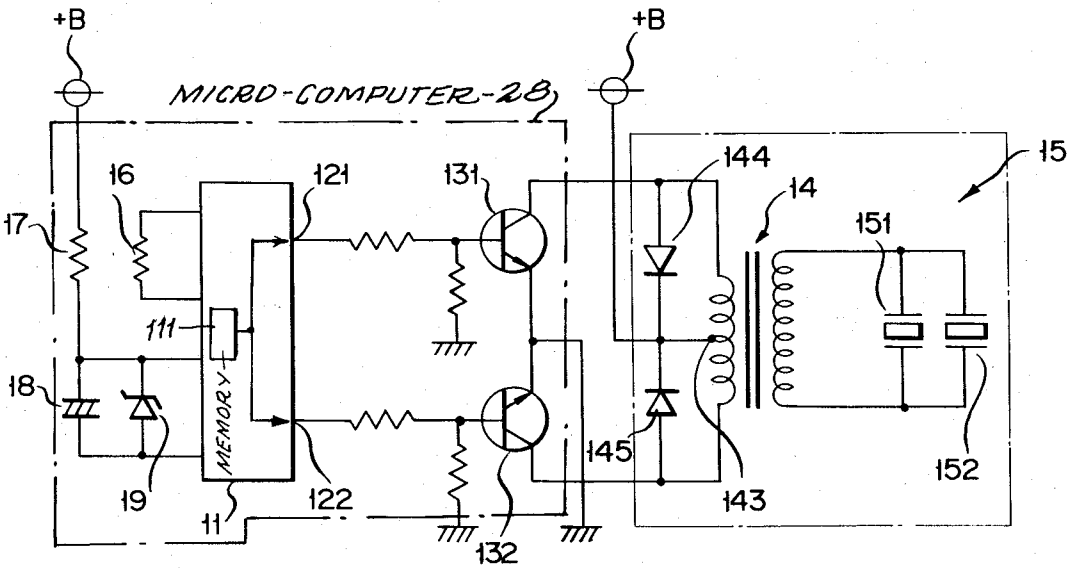
FIG. 13 is a circuit diagram of another horn.

First and second sounding devices 151 and 152 are connected in parallel to the secondary side of transformer 14 as is shown in FIG. 13. However when the sounding device is a diaphragm that uses piezoelectric elements having a wide resonance band, or when electromagnetic speakers are used, it is possible to produce a chord using only one sounding device.

The above has been a description of a chord that is composed of two signals having basic frequencies of 400 Hz and 500 Hz. These frequencies, however, may be given any value by varying the value of resistor 16, which is shown in FIGS. 1 and 13. The ratio of the two basic frequencies has been described as 4:5 or 5:6 but it may be 3:4 or 6:7, for example, as any natural number ratio will produce a chord sound.

In the above embodiments a 1-bit microcomputer was used but other integrated circuits may be used instead. For example, with a memory-equipped integrated circuit the waveforms are prestored in the memory. This integrated circuit may be a melody generation circuit which has a memory in which waveform data is stored and which is read out over a period of time and output from the output ports. The apparatus may also use a 4-bit or 8-bit microcomputer instead of a 1-bit microcomputer but a complicated, high-power microprocessor is not required.

The square-wave pulse-train signals shown in FIGS. 3A, 4A and 5B are pulse modulated such that the pulse widths vary in arithmetical progression. The pulse wave shown in FIGS. 3B, 4B, 5A and 5C has pulse widths that vary in geometrical progres ion. With this kind of pulse width modulation the following features in timbre change are produced.

When, using a sound generator as shown in Japanese Patent Disclosure (KOKAI) No. 57-210395 and when, for example, the basic frequency is 500 Hz and one wishes to form a square-wave pulse-train signal in which the frequency of the third harmonic component (1.5 kHz) is the main component of the sound pressure, only a single pattern in which two pulses, which are obtained by setting the frequency to f=1.5 kHz and the dividing ratio to N=3, are on and one pulse is off, can be obtained, so the timbre and sound pressure are fixed. Accordingly, it is possible in this case to produce a sound which is required as a warning sound for an automobile and which includes a basic frequency component and its harmonic component. It is, however, not possible to freely set the ratio between the basic frequency and the harmonic component. In this case it is not possible to satisfy the demand for a horn that can vary the timbre and sound pressure in response to the situation or the wishes of the automobile user.

The structure and dimensions of a sound producing apparatus that is mounted on an automobile vary depending on the automobile. The sound producing apparatus of this invention has different frequency characteristics which are based on its particular design. Accordingly, when this apparatus is constructed for use as the horn of an automobile, the frequency characteristics of the pulse train signal generated by the driving circuit must be made to match the frequency characteristics of the sound producing apparatus in order for an effective sound to be generated. More precisely, if the drive pulse train signal and the frequency characteristics of the sound producing apparatus do not match, it will not be possible to efficiently produce a sound using the resonance of the apparatus. Therefore, the pulse train signal shown in FIG. 14 has uniform characteristics and cannot be matched with the sound producing apparatus.

When this kind of sound producing apparatus is used as an automobile horn, it is desirable that the basic frequency and its harmonic component and the sound pressure resulting from these frequency components, i.e., the frequency spectrum can be designed to produce a warning sound.

The drive signal of the sound producing apparatus of the above embodiments was composed of square-wave pulse signals. The unit pulse train composed of these pulse train signals is a collection of square-wave pulses having different pulse widths. Accordingly, by varying the width of these pulses it is possible to generate any frequency spectrum desired, and a sound source signal that matches the frequency characteristics of the horn is produced.

Figure 15:
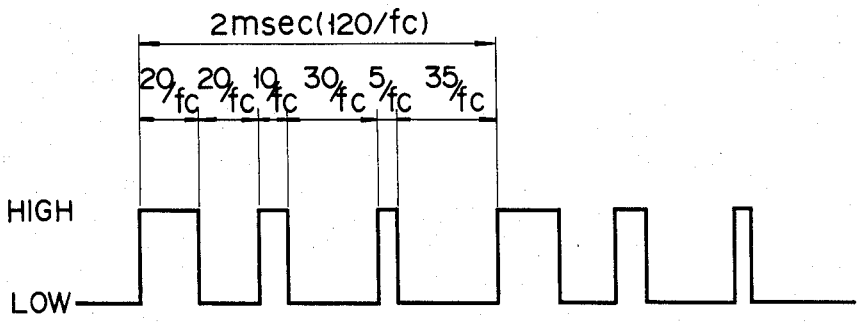
FIG. 15 shows an example of another square-wave pulse-train signal.
Figure 16A:
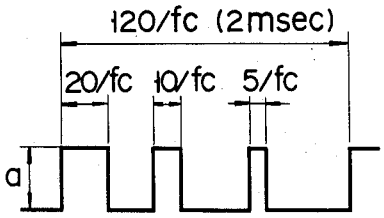
FIGS. 16A and 16B show the unit pulse train of the signal shown in FIG. 15 and its frequency characteristics.

The unit period of the modulated pulse train signal shown in FIG. 15 is 2 ms (basic frequency of 500 Hz), which is the duration of one cycle of the program, as is shown by the one unit pulse train portion of FIG. 16, and the plurality of pulses that comprise the unit pulse train are within this unit period, or, more precisely, one unit pulse train is comprised of three square wave pulses with different pulse widths.

Figure 16B:
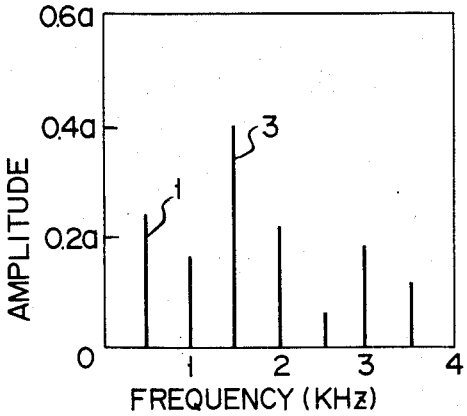

In this embodiment the widths of these three pulses decrease by half in geometrical progression, 20/fc, 10/fc, 5/fc, for example. In this case the common ratio r is 0.5. The frequency distribution of the sound produced by this kind of pulse train is shown in FIG. 16B.

When the pulse width varies in geometrical progression, the influence of the common ratios r on the harmonic components and the basic frequency components is considered as follows.

Figure 17A:
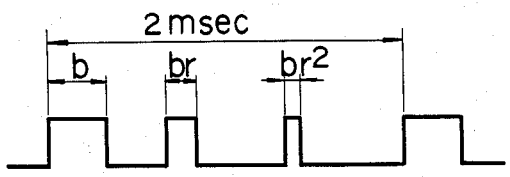
FIGS. 17A and 17B show the structures of the different unit pulse trains and the measurement results of their frequency characteristics.

In order to form pulse train signals having different common ratios r, the program contents of microcomputer 11 are changed so that the pulse width of the three signals that comprise the unit pulse train shown in FIG. 17A decreases in geometrical progression. When a signal having this kind of construction is output from microcomputer 11, the relationship between the geometrically progressive common ratios r of the basic frequency component of the signal appearing at the secondary side of step-up transformer 14 and the third harmonic component has been experimentally determined using a frequency analyzer, and the results are shown in FIG. 17B.

Figure 14:
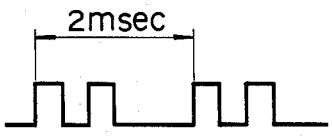
FIG. 14 shows the waveform of unit pulse train.
Figure 17B:
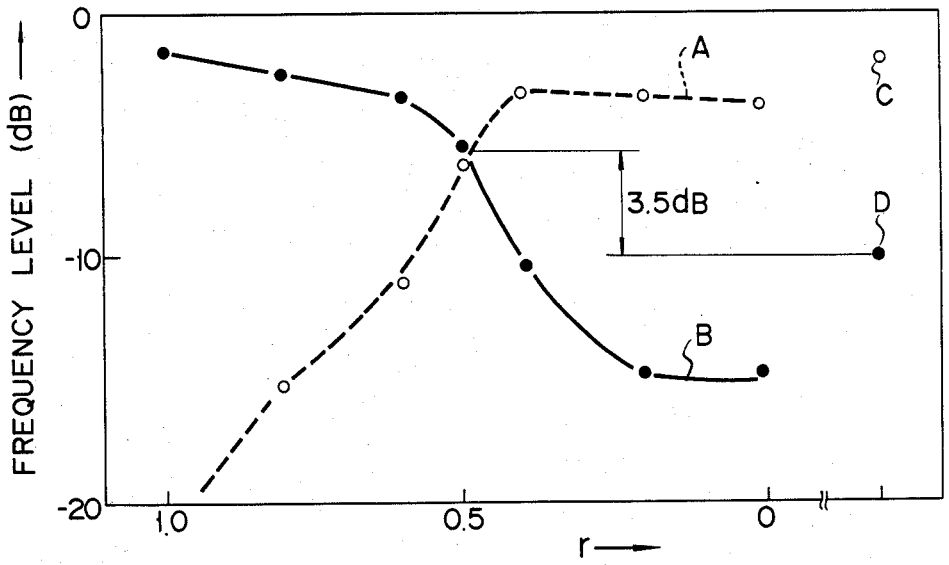

Broken line A in FIG. 17B is the basic frequency component, solid line B is the third harmonic component and C and D are the basic frequency and third harmonic components of the unit pulse train shown in FIG. 14.

As is clear from this experiment, if the common ratio r is set near 0.5, the third harmonic component, while to a certain extent containing the basic frequency component, can be made 3.5 dB larger than D. The waveform shown in FIG. 16A corresponds to this 0.5 common ratio. With this kind of waveform the 1.5 kHz drive voltage component (third harmonic component), which is the secondary resonance frequency of the sound producing apparatus shown in the example of FIG. 16B, can be increased. Accordingly, the sound pressure of the sound produced by this apparatus can be increased. Also, in this case, the primary component, which is the basic frequency component, is included sufficiently and the timbre of the sound produced can be given a soft quality.

From these experimental results, it can be seen that by making the common ratio r larger than the experiment range shown in FIG. 17B, i.e., decreasing the changes in pulse width, it is possible to increase the third harmonic component, and by decreasing the common ratio r it is possible to produce a soft sound with a large basic frequency component.

In the above description, when the common ratio r is made larger than 0.5, the third harmonic component is increased while still containing a certain basic frequency component making this apparatus very effective as the horn of an automobile. In FIG. 17B, however, a state is shown in which the third harmonic component B and the basic frequency component A are nearly the same as when the common ratio r is 0.5. FIG. 16B shows the characteristics of the waveform of FIG. 16A in which the common ratio r is 0.5 and third harmonic component 3 is much larger than basic frequency component 1. FIG. 16B is a frequency analysis of the signal obtained from the output port of the microcomputer and FIG. 17B is a frequency analysis of the drive voltage signal of the apparatus. The reasons why the ratio of the basic frequency component and the third harmonic component are different despite the fact that the common ratio r is the same and characteristics shown in FIGS. 16B and 17B were obtained using the same frequency analyzer is as follows.

(1) The impedence of the step-up transformer and the sounding device, which uses a piezoelectric element, varies with changes in frequency. Consequently, the frequency characteristics of the signal output from the port of the microcomputer are amplified without any other changes and are disimilar to the frequency characteristics of the drive voltage signal of the sounding device.

(2) The characteristics shown in FIG. 16B were obtained using a normal scale whereas the characteristics shown in FIG. 17B were obtained using a log scale, so the difference between the basic frequency component and third harmonic component appear larger.

In order to obtain a pleasant sound, it is known to synthesize two sounds making the basic frequency relationship an integer ratio such as 4:5. This ratio may be 4:5.1 or 400 Hz and 510 Hz for producing a pleasant chord sound with even better timbre.

It is necessary, however, that the number of unit periods included in one chord period be close to an integer. For example, when a basic frequency of 400 Hz is to be obtained, if unit pulse train of 4.8 unit periods of 1/400 Hz is included in the repeated chord period and the repeated chord period is taken as being $$4.8/400 = 1/83.33$$

then the frequency of the sound produced will be 83.33 Hz, which is a great distortion from the 400 Hz. Ideally, in order to prevent this distortion, it is necessary to provide from 4.9 to 5.1 pulse trains (or substantially an integer of 5).

Figure 18A:
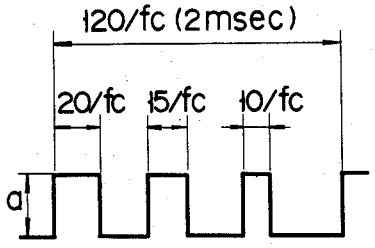
FIGS. 18A, 19A, 20A, 21A show different unit pulse examples.
Figure 18B:
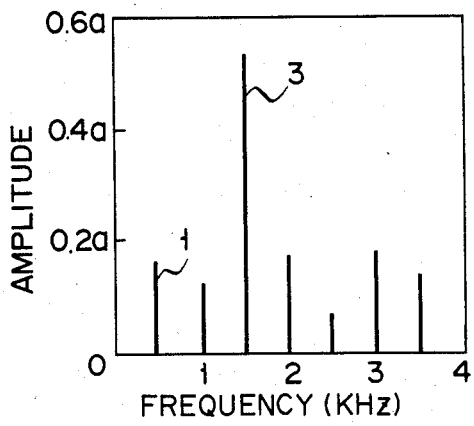
FIGS. 18B, 19B, 20B, 21B show frequency characteristics of the above unit pulse trains.

Next, consideration is given to the sound produced when the unit pulse train is comprised of pulse signal trains in which the pulse width is modulated. The unit pulse train shown in FIG. 18A is comprised of 3 pulses having widths that decrease in arithmetical progression, and the characteristics of which are shown in FIG. 18B. Compared to the waveform shown in FIG. 16A the amount the pulse width decreases is smaller, but the third harmonic component, which becomes the higher order harmonic component, is included in a larger quantity and a sound of high pressure is produced.

Figure 19A:
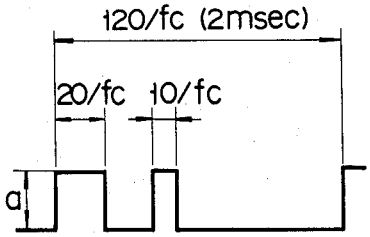
Figure 19B:
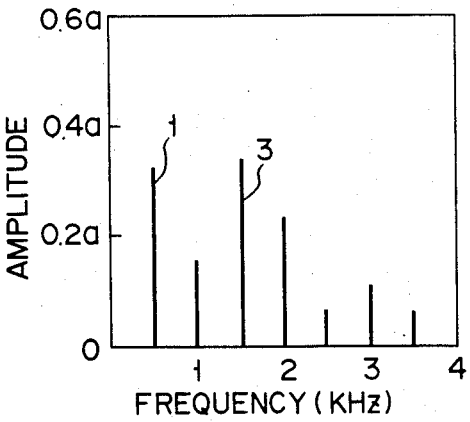

The unit pulse train shown in FIG. 19A has two pulses in one unit period. With this kind of waveform the sound pressure drops slightly, as is shown in FIG. 19B, but a soft sound with a large basic frequency component is produced.

Figure 20A:
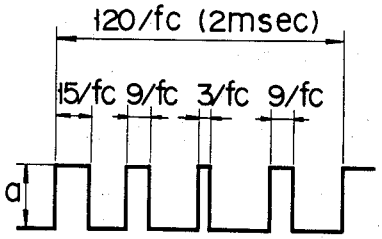
Figure 20B:
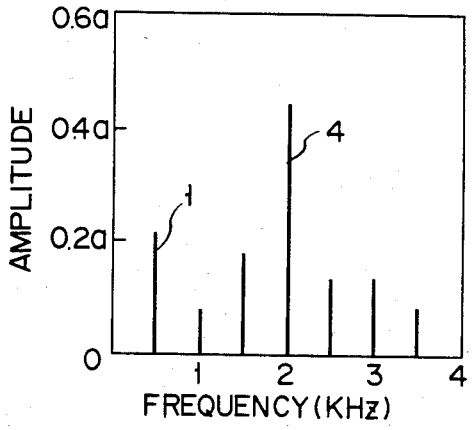

The unit pulse train shown in FIG. 20A contains four pulses in one unit period of 2 ms, for example, in response to the resonance characteristics of the piezoelectric sound-producing apparatus. As shown in FIG. 20B a large fourth harmonic component 4, which is the higher order harmonic component, is contained in the pulse train.

Figure 21A:
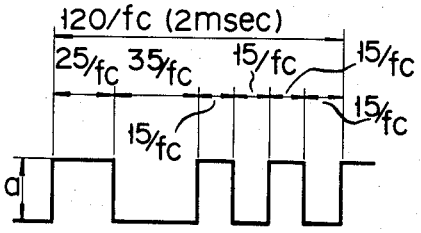
Figure 21B:
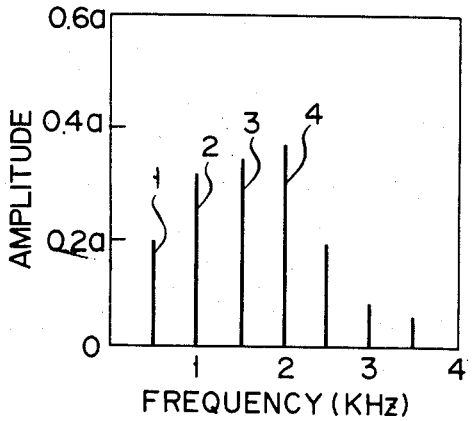

With the unit pulse train shown in FIG. 21A one of the pulses of the four pulses in a unit period is off. With this kind of waveform it is possible to increase the secondary to fourth harmonic components 2 to 4 (FIG. 21B).

What is claimed is:

1. A warning chord sound producing apparatus, comprising:

an integrated circuit including a memory for storing program data, a clock signal generator providing a plurality of clock signals with a predetermined frequency, microprocessor means for executing said program data, and at least two output ports outputting a low signal and high signal constructing square-wave pulse trains, said memory having a plurality of addresses, in one of which, one of said program data is stored providing an instruction so that said low signal and said high signal appear at one of said plurality of output ports;

a semiconductor switching means, which is controlled by said square-wave pulse trains from said output ports of said integrated circuit, so that said semiconductor switching means produces a plurality of output signals;

sound producing means, including at least first and second sound producing elements driven by said output signals from said semiconductor switching means, for producing a chord sound;

said instruction of said program data determining one of said output ports for outputting of said low signal or high signal and for selecting a level of said low signal and high signal;

said means for executing said program data executing said instruction in one of said addresses of said memory in order and one by one when said clock signal generator generates one of said clock signals such that one of said output ports outputs a part of said square-wave pulse trains and another one of said output ports outputs another part of said square-wave pulse trains;

said square-wave pulse trains having a first and second square-wave pulse train signal component;

said first square-wave pulse train signal component comprising a plurality of first unit pulse trains having a duration of a first unit period, which includes a first basic frequency and first harmonic frequencies which are a plurality of multiples of said first basic frequency, said second square-wave pulse train signal component comprising a plurality of second unit pulse trains having a duration of a second unit period, which includes a second basic fequency and second harmonic frequencies which are a plurality of multiples of said second basic frequency, a ratio of said first and second basic frequencies being a ratio of natural numbers so that said first and second basic frequencies define a chord;

said means for executing said program data outputs, repeatedly, said square-wave pulse trains from said plurality of output ports, one period of repetition of said square-wave pulse trains being a duration of a chord period defined as a natural number of said first unit periods and second unit periods, respectively; and said semiconductor switching means including at least two transistors which are controlled by said part of said square-wave pulse trains and said another part of said square-wave pulse trains respectively, from said at least two output ports.

2. An apparatus according to claim 1, wherein said integrated circuit is comprised of a microcomputer.

3. An apparatus according to claim 1, wherein a square-wave pulse-train signal, which is comprised of unit pulse trains having different basic frequency components for each output port, is output from each of said plurality of output ports of said integrated circuit.

4. An apparatus according to claim 1, wherein one period of repetition of square-wave pulse trains from said integrated circuit is a period in which is included a plurality of said first and second unit periods, the number of which are substantially equal to an integer.

5. An apparatus according to claim 1, wherein said sound producing apparatus is comprised of a transformer, which steps up the output signals from said transistors and said first and second sound producing elements comprise at least two piezoelectric elements that are driven by an output signal from said transformer.

6. An apparatus according to claim 1, wherein said unit pulse train is comprised of a plurality of pulse signals of different pulse widths.

7. An apparatus according to claim 5, wherein said step-up transformer comprises a plurality of groups of transformers to which are supplied output signals from each said plurality of semiconductor switching elements, and the output signal from each transformer is supplied to said at least two piezoelectric elemetns, which each have different resonance frequencies.

8. An apparatus according to claim 5, wherein said step-up transformer comprises one transformer having an intermediate tap terminal in the primary winding side, the output signal from each of said semiconductor switching elements being supplied to said primary winding side and said sounding devices being connected to a secondary winding side of said transformer.

9. An apparatus according to claim 7, wherein said sounding devices include different sized said piezoelectric elements, having different primary resonance frequencies, connected in parallel to the second winding side of said step-up transformer.

10. An apparatus according to claim 7, wherein said at least two piezoelectric elements have different diameters, and at least two piezoelectric elements are included in a single housing.

11. An apparatus according to claim 8, further comprising a pair of surge-voltage absorbing diodes which are connected between the intermediate tap terminal and the primary winding of said step-up transformer.

12. An apparatus according to claim 6, wherein said unit pulse train is comprised of a plurality of pulses, the number of which is 2 to 4.

13. An apparatus according to claim 12, wherein said unit pulse train is comprised of a combination of a plurality of square wave pulses whose pulse widths vary by a set ratio.

14. An apparatus according to claim 13, wherein said unit pulse train is comprised of a combination of a plurality of square wave pulses whose pulse widths vary in accordance with a geometrical progression.

15. An apparatus according to claim 13, wherein said unit pulse train is comprised of a combination of a plurality of square wave pulses whose pulse widths vary in accordance with an arithmetical progression.

16. An apparatus according to claim 14, wherein the ratio of said geometrical progression is 0.5 or more.

* * * * *